United States Patent [19]

Stessen

[11] Patent Number: 4,674,408

[45] Date of Patent: Jun. 23, 1987

[54] AMMUNITION ARTICLE CONTROLLABLE DURING ITS FINAL FLIGHT PHASE AND METHOD FOR NAVIGATION THEREOF TOWARDS A TARGET

[75] Inventor: Lothar Stessen, Lauf/Pegnitz, Fed. Rep. of Germany

[73] Assignee: Diehl GmbH & Co., Nuremberg, Fed. Rep. of Germany

[21] Appl. No.: 751,932

[22] Filed: Jul. 5, 1985

[30] Foreign Application Priority Data

Jul. 24, 1984 [DE] Fed. Rep. of Germany ..... 3427227

[51] Int. Cl.[4] ..... F42B 15/033

[52] U.S. Cl. ..... 102/384; 244/3.22

[58] Field of Search ..... 102/384; 244/3.22

[56] References Cited

U.S. PATENT DOCUMENTS

| | | | |
|---|---|---|---|
| 4,300,736 | 11/1981 | Miles | 244/3.22 |
| 4,356,770 | 11/1982 | Atanasoff et al. | 102/384 |
| 4,408,735 | 10/1983 | Metz | 244/3.22 |
| 4,568,040 | 2/1986 | Metz | 102/384 |

FOREIGN PATENT DOCUMENTS

| | | |
|---|---|---|
| 28966 | 7/1984 | European Pat. Off. . |
| 1578139 | 5/1973 | Fed. Rep. of Germany . |
| 2340653 | 4/1974 | Fed. Rep. of Germany . |
| 2353566 | 5/1974 | Fed. Rep. of Germany . |
| 2714688 | 10/1977 | Fed. Rep. of Germany . |
| 3024842 | 1/1982 | Fed. Rep. of Germany . |
| 3042063 | 12/1982 | Fed. Rep. of Germany . |
| 3237485 | 4/1984 | Fed. Rep. of Germany . |
| 1531717 | 5/1984 | Fed. Rep. of Germany . |
| 3427227 | 1/1986 | Fed. Rep. of Germany . |
| 2469345 | 5/1981 | France . |
| 930961 | 7/1963 | United Kingdom . |
| 1075705 | 7/1967 | United Kingdom . |
| 1444029 | 7/1976 | United Kingdom . |
| 2010760 | 7/1979 | United Kingdom . |
| 1578291 | 11/1980 | United Kingdom . |
| 1605007 | 12/1981 | United Kingdom . |
| 2163837 | 3/1986 | United Kingdom . |

*Primary Examiner*—Charles T. Jordan

*Attorney, Agent, or Firm*—Scully, Scott, Murphy & Presser

[57] ABSTRACT

An article of ammunition which is controllable during its final flight phase, which is equipped in its cross-sectional plane through the center of gravity with a radially oriented impulse system which is rotatable about the longitudinal axis of the article of ammunition; article, which is activatable through a control circuit located on board of the ammunition article, upon the detection of a target object which is located on the opposite side relative to the instantaneous orientation of the impulse system through the intermediary of a sensor device. Also disclosed is a method for navigating an article of ammunition which is controllable during its final flight phase towards the target object.

6 Claims, 2 Drawing Figures

12
20
11 v20'h.22h
20'
24
24a
11'
16,17
16'
20
22'h
24'
v11h≈v20'h
22ha
22h
d24/dt = v24
v15h.22h = v24 × |22h|
v20'h.22h ≙ v15h.22h
~ 24 = 24'
v15h.22h
15
v15h
15'

AMMUNITION ARTICLE CONTROLLABLE DURING ITS FINAL FLIGHT PHASE AND METHOD FOR NAVIGATION THEREOF TOWARDS A TARGET

BACKGROUND OF THE INVENTION

1. Field of the Invention

The present invention relates to an article of ammunition which is controllable during its final flight phase, which is equipped in its cross-sectional plane through the center of gravity with a radially oriented impulse system which is rotatable about the longitudinal axis of the article of ammunition; and which is activatable through a control circuit located on board of the ammunition article, upon the detection of a target object which is located on the opposite side relative to the instantaneous orientation of the impulse system through the intermediary of a sensor device. The invention further relates to a method for navigating an article of ammunition which is controllable during its final flight phase towards the target object.

2. Discussion of the Prior Art

An article of ammunition of that type is known from the disclosure of German Pat. No. 15 78 139 in the form of an artillery projectile which has a correctable flight trajectory. However, the invention is, in particular, directed to a (not necessarily projectile-shaped, but also cylindrical) subordinate ammunition article; of which a plurality of such articles are transported over a target area by a carrier and are then expelled therefrom so as to descend, in a more or less defined spatial orientation, while searching the target area for target objects which are to be attacked by means of sensor devices which are arranged in the articles of ammunition, in a direction towards the plane of movement of the target objects, and to then detonate the combat charge at a suitable distance from a detected target object. Such cylindrical subordinate ammunition articles, with consideration being also given to different types of possible implementations concerning their position-finding sensor devices, combat charges and kinematic behavior, are presently well known in this technology, such as, for instance, from the disclosures of U.S. Pat. No. 4,356,770 and British Pat. No. 1.444,029, and need not be described in detail herein.

The greatest degree of penetrating effectiveness against heavily-armored target objects is evidenced by articles of ammunition with combat charges which at a close approach to the target object, will deform a pointedly-conical insert into a highly energetic stream of particles.

However, problems are encountered in that the target tracking-follow up controls which must be implemented in the articles of ammunition (for a close target approach) necessitate a high energetic as well as apparative demand; such that, presently the constructive demand for the steering to the target is especially high when the article of ammunition does not relate to a body which has an aerodynamic flow-enhancing configuration with steering guidance surfaces according to the type of an artillery projectile which can be steered during its final flight phase, but relates to the more inexpensive and lesser demanding cylindrical configuration of the subordinate ammunition articles.

In a projectile with a correctable trajectory pursuant to the above-mentioned published class of projectiles, there is incorporated in the cross-sectional plane of the center of gravity of the projectile, a radially oriented firing tube for an auxiliary projectile (fireable by means of at least one auxiliary charge). Due to this firing reaction, a lateral acceleration is temporarily superimposed upon a constant longitudinal velocity of the projectile, in order to displace or shift the (up to now ballistic) trajectory for tracking of the target. For this purpose, it is necessary that during the entire length of the flight up to the target object, the projectile actually maintains a constant longitudinal velocity. Herein, the sensor device should detect the appearance of the target object under a fixedly pregiven deviation angle; and correlated therewith should be the resultant changed trajectory, which is fixedly pregiven through the vectorial superposition of the crosswise or lateral acceleration. A discontinuous correcting of the trajectory of that type imparted to a momentary target tracking course; however, as can be ascertained, can only lead to a strike against a target object which is implementing maneuverings on its part when, at least at a closer target approach, there again becomes effective a continuously operating follow-up tracking system; however, standing in opposition thereto is that upon a close approach to the target, in actual practice, the sensor device become ineffective; in effect, is overcontrolled.

SUMMARY OF THE INVENTION

Accordingly, in recognition of these conditions it is an object of the present invention, especially under ballistic conditions which are not defined, that the ammunition and the subordinate ammunition articles which are to be conducted towards the target object are imparted, without the necessity of any extensive energetic and constructive demand, a substantial reduction in any deviation from a hit or strike, thereby providing a much more effective utilization of especially armor-piercing ammunition with a spray or jet-forming hollow charge insert.

The foregoing object is inventively achieved in an article of ammunition as described hereinabove, in that the impulse system is formed of a plurality of pulse transmitters which are arranged along the periphery of the article of ammunition, wherein the sensor device is designed for the continuous tracking of a target object which has once been detected, for delivery of target deviating information regarding distance and direction to the control circuit; and wherein through the intermediary of the control circuit there is activated that particular pulse transmitter which due to its given power range and its momentary orientation with respect to a spatial displacement of the sighting line on board of the ammunition article relative to the detected target object, will counteract the thereby produced vectorial speed change during the approach of the ammunition article to the target object.

The foregoing provides the advantages of an energetically satisfactorily-implementable discontinual trajectory correction during the approaching movement of the article of ammunition to the detected target object and, on the basis of a target tracking with derivative action (in effect, with the constant direction-finding of the proportional navigation), because of the theoretically greatest possible hit or strike precision of a collision course-navigation, the most effective precisely-pointed utilization of the jet-forming combat charge in combination with each other. Due to the derivative action behavior of this approaching movement to the target by the article of ammunition, it is no longer disturbing that as a result, finally, at a closer approach to the target object, the sensor device (for determining the sighting line through constant target detection from the ammunition article) will fail due to excessive excitation; inasmuch as the impact point has been already extrapolated.

As a result of the known power range of the constructively predetermined assembled orientation of the pulse transmitters which are effective in the cross-sectional plane of the center of gravity, the activation of a pulse transmitter produces a lateral acceleration, which is previously known in the body-fixed coordinate system of the ammunition article pursuant to the amount and direction, which momentarily (essentially given by the acceleration caused by the gravitational pull of the earth) vectorially superimposes itself upon the approach movement of the article of ammunition to the detected target object. Pursuant to the inventive object, there need thus be merely obtained on board of the ammunition article from the continuous observation, the commencement of a spatial displacement of the sighting line (from the ammunition article to the momentarily detected target object), by means of which through a momentary lateral acceleration of the ammunition article, there can be compensated this displacement of the sighting line, in order to again achieve the steady bearing or direction-finding. During the course of the rotation of the article of ammunition about its longitudinal axis, there is then activated the particular one of the still available pulse transmitters which currently possesses the appropriate orientation for the delivery of precisely this lateral acceleration. Should the amount of the such delivered lateral pulse still be inadequate for effecting a change in the approach velocity necessary for the steady direction-finding, in order to stop the wandering movement (displacement) of the momentary sighting line, there is then effected the activation of a further pulse transmitter, as soon as this has turned into the previously determined direction opposite the target object detected by the sensor. This procedure is again repeated when, due to an excessive lateral acceleration or because of a change in motion carried out by the target object, the sighting line again tends to displace.

Consequently, the original approaching movement of the article of ammunition; when needed, through a sequence of steps, is imparted such kinds of changes, so that always, at least transiently, there will again adjust itself the spatially constant oriented sighting line (constant direction-finding or bearing of the article of ammunition relative to the detected target object) and, as a consequence, the overall small hitting deviation of the collision course pursuant to the proportional navigation. Required for this purpose is merely a certain influence over the radial motion components of the article of ammunition; and therefore it does not even need the requirement for an inertial system for determining the motion components of the article of ammunition within the space of the movement of the target object when, for example, by means of flow-dynamic media, there is predetermined an approximated normal orientation of the article of ammunition during its approach to the plane of movement of the detected target object.

BRIEF DESCRIPTION OF THE DRAWINGS

Additional alternatives and modifications, as well as further features and advantages of the invention, may now be ascertained from the following detailed description of an essentially abstractly represented embodiment of the invention, taken in conjunction with the accompanying drawings; in which.

DETAILED DESCRIPTION

Figure 1:
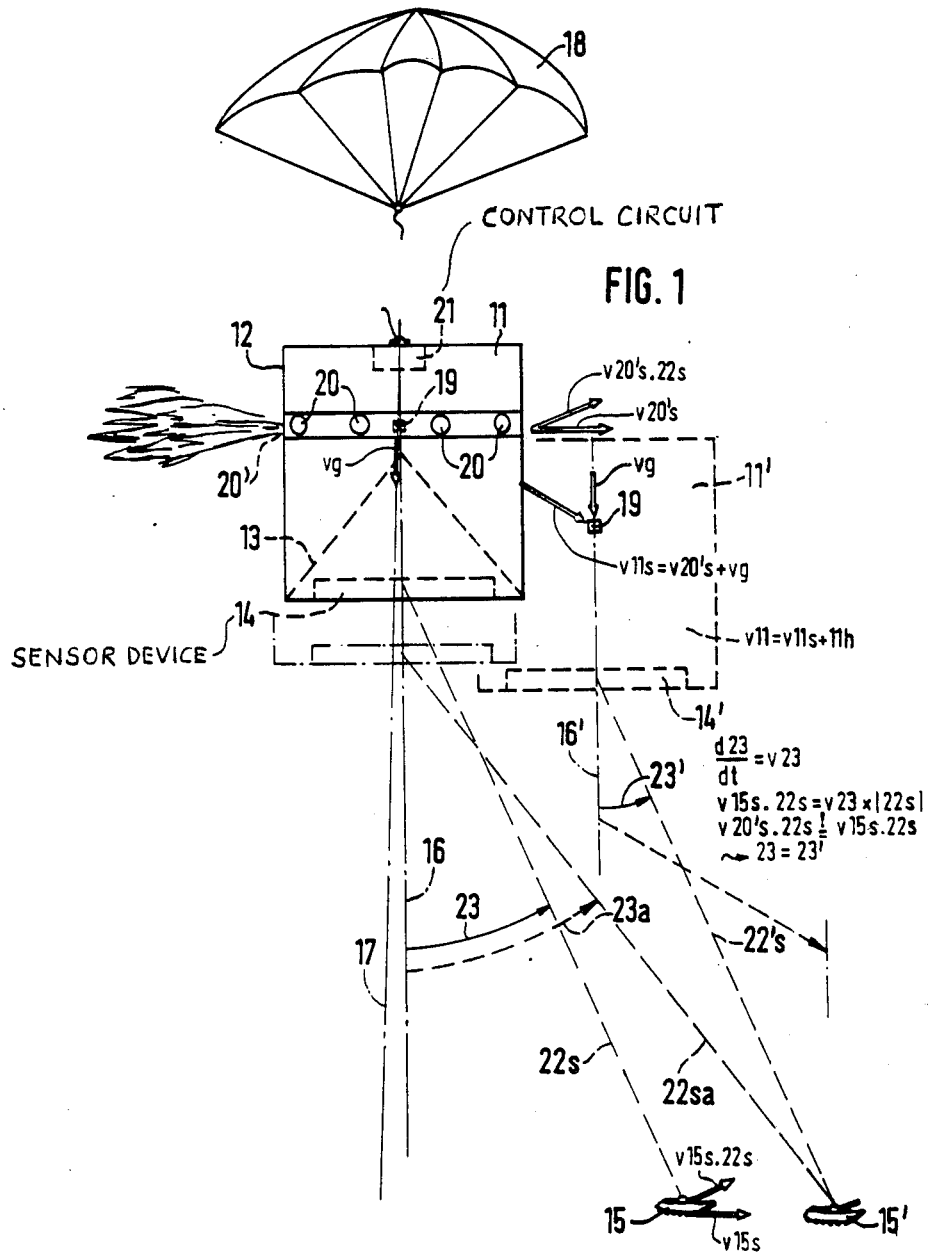
FIG. 1 illustrates in a horizontal view, an article of ammunition which is equipped with pulse transmitters, shown during the detection of a moving target object.

The article of ammunition 11 which is illustrated in a side view in FIG. 1 relates to subordinate ammunition wherein a cylindrical housing 12 has arranged therein a spray or jet-forming hollow charge insert 13. The ammunition article 11 is equipped (shown herein symbolically at the front side) with a sensor device 14; for example, with an active millimeter wave position-finding arrangement (radar), in order to constantly determine the angular extent and distance of the derivation of a target object 15, relative to a coordinate system fastened to the body, with the rotational and longitudinal axis 16.

The (subordinate) article of ammunition 11 which is expelled from a carrier (not shown in the drawing) over the target area in which there is detected or at least suspected the presence of at least one target object 15 which is to be attacked, rotates at a rotational speed of a few revolutions per second about its longitudinal axis 16, which subsequent to a certain stabilizing flight phase coincides at least approximately with the object 15. In the interest of providing this orientation as indicated in FIG. 1, during the stabilizing phase subsequent to the expulsion of the subordinate ammunition from carrier, a parachute 18 could have been attached to the article of ammunition 11, which was then again separated therefrom.

In the plane through the center of gravity 19 of the article of ammunition 11 which is oriented transverse to the axis 16, arranged about the periphery of its housing 12 are radially oriented pulse transmitters 20 (for example, in the form of detonator-like pulse charges, or pulse-like functioning small jet propulsion devices) which can be selectively (ignitable or) activated through a control circuit 21, pursuant to the extent of their spatial orientation relative to the target object 15 which has been detected by the article of ammunition article 11.

Figure 2:
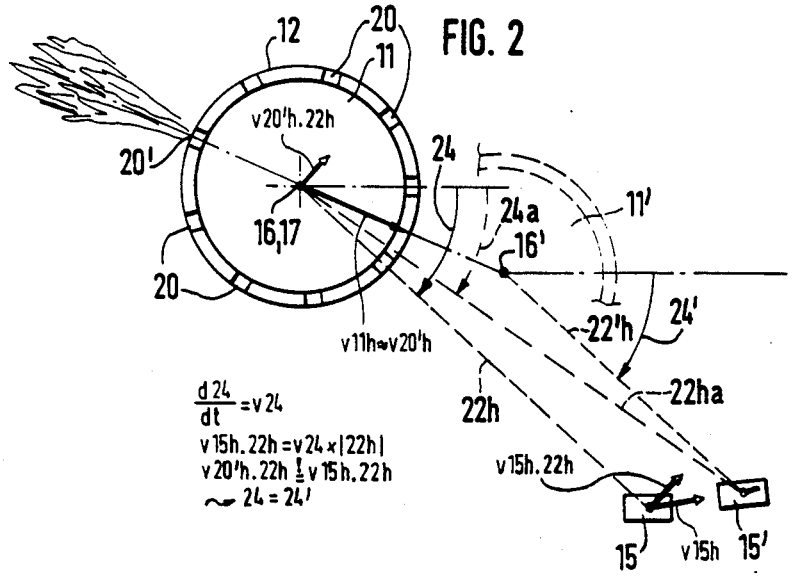
FIG. 2 illustrates the article of ammunition and the target object pursuant to FIG. 1 in a vertical plan view directed against the plane of movement of the target object.

The momentary movements of the article of ammunition 11, as well as that of the target object 15 which is tracked by its sensor device 14, and the momentary spatial position of the sighting line 22*s*-22*sa*-22′ therebetween, permit themselves to be represented, vectorially separated into their components, in the target moving or horizontal plane h (in accordance with the plan view sketch in FIG. 2) and in a perpendicularly thereto oriented vertical plane s (in accordance with the view in FIG. 1). In conformance with the extent of the relative motion between the velocities vll of the article of ammunition 11 and v15 of the target object 15, the sighting line 22*s* therebetween is imparted a spatial displacement. This is detectable on board the article of ammunition 11 by means of the sensor device 14 and, upon being separated into components, evaluatable in the control circuit 21 as the timewise variation of a vertical position-finding angle 23, (relative to the longitudinal axis 16 of the body), and a horizontal position-finding angle 24 (relative to a reference orientation fixed on the body) as the direction-finding angular velocities v23 and v24; entered equation-like in FIG. 1 and FIG. 2, with consideration given to the fact that the speed of the object always presents itself as a vector product of the radius and the angular velocity.

Pursuant to the known geometric relationships of the derivative action or proportional navigation (referring, for example, to the disclosure of British Pat. No. 1,605,007, FIG. 2, for the tracking of the target object in its plane of movement) two bodies which move relatively to each other then run along a collision course, when the sighting line between them maintains a spatially constant direction-finding or bearing angle (so-called "constant bearing"). Consequently, the article of ammunition 11 must miss the target object 15 when, for example, pursuant to the initially considered presumption of the relative movement therebetween shown in FIG. 1, this then leads to a timewise change (v23) in the sighting line 22*s*-22*sa*, when hereby the mentioned direction-finding angle 23-23*a*/24-24*a* is not constant over the course of time.

From this there follows, on the other hand, that the article of ammunition 11 finds itself on a collision course with the target object 15, and, as a result, immediately before the impact, can optionally bring into effect a spray or jet-forming charge precisely aimed into the armored target object, when through a suitable change in the movement v11, it becomes possible for the ammunition article 11 which is to be moved towards the plane of movement of the target object, to compensate for these direction-finding or bearing angle changes; in effect, (always again transiently) to attain the on board the ammunition article 11 spatially-fixed available ("constant") direction-finding.

Serving for the corresponding influence over the approaching movement of the article of ammunition 11 are the pulse transmitters 20 which are arranged transverse to its axis 16. These can be of different power ranges; in effect, during their activation they produce different lateral pulses in the cross-sectional plane of the center of gravity. However, all of the pulse transmitters 20 can be also designed so as to be identical with respect to each other. Hereby, it is decisive that every one of the pulse transmitters 20, because of rotation about the longitudinal axis of the article of ammunition 11 (irrespective as to whether the pulse system rotates relative to the article of ammunition 11 or is fastened thereto), can assume every azimuthal orientation; and that, due to the constructive conditions on the article of ammunition 11, there is determinable in the control circuit 21 an azimuthal association between the momentary sighting line 22*s* and the momentary orientation of every one of the still available (although not yet activated) pulse transmitters 20; in essence, evaluatable for the intended activation.

Pursuant to the demands of the equations which are entered in the drawings; by a known extent by means of a parallel displacement of the sighting line 22*s*-22′*s*, there is again achieved the constant direction-finding or bearing of the article of ammunition 11 towards the target object 15. For this purpose, a velocity change v11 which is caused by the pulse transmitter 20′, representable from the vector components v11h in the plane of movement of the target object 15 and v11*s* in the vertical plane by 22*h*, must just compensate the vector sum of the angular velocities v24, v23 of the sighting line components 22*h*, 22*s*.

On board of the ammunition article 11 there must thus be merely constantly trigonometrically determined the projected target distances /22*h*/ and /22*s*/, as well as their angular velocities v23, v24 from the measured target distance /22*s*/ and the angular target displacement in a trigonometric manner. Obtained therefrom are the target motion components v15*h*.22*h* and v15*s*.22*s* which are perpendicular to the sighting line 22*s*. Thus, there are to be investigated the momentary positions of the still available pulse transmitters 20 (pregiven pulse dimensioning), as to whether a pulse transmitter 20′ has just turned into a direction (relative to the detected target object 15) in which its activation leads to that change in velocity v11 which in every instance reduces the actual angular velocities v23, v24, in order to counteract the actual determined deviation of the sighting line 22*s*; in order to at all possibly again produce a parallel sighting line 22′*s* through the new location of the target 15. For this reason, a pulse transmitter 20′ must then be activated when its lateral acceleration due to its momentary orientation (at a known pulse dimensioning) will just possibly cause a resultant change in the velocity v11*h*+v11*s* with the partial component vectors v20+*h*.22*h* and v20′*s*.22*s*, which are as large as the motion vectors v15*h*.22*h* and v15*s*.22*s* which are determined on board by the sensors. In order that herein, in general, (namely, with pulse transmitters 20 which are oriented not exactly in parallel with the target motion plane h) there will also presently act vector components in the direction of the sighting line /22*s*1=22*s*+22*h*, causes only a slight offset of the collision timepoints, without any influence on the proportional navigation itself.

This criterium is always readily approximatable inasmuch as, irrespective as to whether the pulse transmitters 20 are of different power ranges or are identical with respect to each other, the lateral acceleration produced upon the activation of a certain pulse transmitter 20′ (for effecting a velocity change v11) is known; since it only depends upon the momentary azimuthal orientation of the pulse transmitter 20′ which is to be activated and upon its constructively predetermined dimensions. Thus, by means of the known means, the vector-matrix algebra, there can be determined within the control circuit 21 which of the available pulse transmitters 20 (in which azimuthal position relative to the target object 15) is to be activated, in order to possibly fulfill the described equation conditions; in effect, to counteract any deviation out of the sighting line 22*s*. When, after a first activation of a pulse transmitter 20′ the velocity change vll required therefore still has not been reached, then at the next opportunity (after corresponding rotation of the pulse system), there is activated the next available pulse transmitter 20′ (with a suitable charge); from which there will set itself the step-like collision course sequence which is drawn in FIG. 1.

The described conditions are also applicable when (in contrast with the simplified assumption for the previously described drawing) the axis of rotation 16 of the descending impulse system does not point approximately perpendicular towards the plane of movement h of the target object 15 which is to be attacked, but is suitably otherwise oriented relative thereto. Nor must the article of ammunition 11, for instance by enhancing its sensor device 14 with an inertial system, then be equipped with sensor devices for the determination of the momentary orientation of the article of ammunition 11 within the space of target motion and the control circuit 21 must be equipped with a correspondingly enhanced evaluating circuit for the conversion of the motion vectors which are obtained with regard to the coordinate system which is fastened to the body into the spatially-fixed coordinate system, in which there moves the target object 15 and the article of ammunition 11 together with its impulse system. However, on the basis of the known Euler coordinate-transformation equations, no basic difficulties stand in the way of such a conversion.

What is claimed is:

1. In an article of ammunition which is controllable during its final flight phase; an impulse system in the cross-sectional plane of the center of gravity of said article which is radially oriented and rotatable about the longitudinal axis of said article; sensor means on said article for detecting a target object; and a control circuit on board of said article for activating said impulse system subsequent to the detection of the target object located opposite thereto relative to the momentary orientation of said impulse system; the improvement comprising: said impulse system comprising a plurality of pulse transmitters arranged about the periphery of said article of ammunition, said sensor means providing for the constant tracking of a singly detected target object and for deliverying target deviating information relative to distance and direction to said control circuit, said control circuit activating the particular pulse transmitter which, predicated upon its inherent power range and its momentary orientation counteracts a spatial displacement of a sighting line on board of the article of ammunition towards the detected target object as a result of the thereby produced vectorial change in velocity in the approach of the article of ammunition to the target object.

2. An article of ammunition as claimed in claim 1, wherein said pulse transmitters have differing power ranges.

3. An article of ammunition as claimed in claim 1, wherein a plurality of said pulse transmitters are activated in sequence upon being presently turned into the spatial orientation for compensating a displacement of the sighting line.

4. An article of ammunition as claimed in claim 1, wherein upon the determination of the sighting line there is imparted to the article a normal orientation relative to the plane of motion of the target object.

5. An article of ammunition as claimed in claim 4, wherein the axis of rotation of the impulse system of the article oriented essentially perpendicular to the plane of motion of the detected target object coincides therewith.

6. An article of ammunition as claimed in claim 4, wherein said article is equipped with an orienting parachute at least during an initial and stabilizing flying phase in the approach thereof to the target object.

* * * * *